United States Patent [19]

Kelstrom et al.

[11] 4,406,142

[45] Sep. 27, 1983

[54] ANNULAR CORRUGATOR

[75] Inventors: Donald G. Kelstrom, Elmhurst; John D. Williams, West Chicago; Lester H. Woodrich, Elgin, all of Ill.

[73] Assignee: UOP Inc., Des Plaines, Ill.

[21] Appl. No.: 297,907

[22] Filed: Aug. 31, 1981

[51] Int. Cl.[3] ..... B21D 15/06

[52] U.S. Cl. ..... 72/98; 72/77

[58] Field of Search ..... 72/77, 78, 95, 98, 100

[56] References Cited

U.S. PATENT DOCUMENTS

| | | | |
|---|---|---|---|
| 2,429,491 | 10/1947 | Schuler | 80/58 |
| 3,128,821 | 4/1964 | Andersen | 153/71 |
| 3,353,389 | 11/1967 | Kelstrom | 72/77 |
| 3,387,477 | 6/1968 | Shupper | 72/77 |
| 3,656,331 | 4/1972 | Kuypers | 72/77 |
| 4,215,559 | 8/1980 | Kuypers | 72/77 |
| 4,339,936 | 7/1982 | Pressman | 72/77 |

*Primary Examiner*—Lowell A. Larson

*Attorney, Agent, or Firm*—James R. Hoatson, Jr.; Barry L. Clark; William H. Page, II

[57] ABSTRACT

Apparatus for producing annular corrugations in the wall of thin metal tubing in the manufacture of corrugated metal hose includes a plurality of dies. Each die comprises a helical rib of greater than 360° extent formed on the inner rim of an annular ring with the ribs on successive dies being progressively thinner and having successively closer pitches so as to progressively deepen the corrugations and make them narrower. The dies are mounted to rotate in synchronization with each other at identical angular speeds, and are arranged in pairs in one or more stages with the dies in each stage engaging opposite sides of the tube. A non-rotatable guide member projects inside the first die ring and has an aperture to permit the die to contact the tubing at one location on the tubing circumference while the remainder of the tubing is rigidly supported against collapse by the guide member. Transfer of the corrugations from one die ring to the next is assisted by providing the intermediate dies with lead-in portions having the same pitch as the preceding die ring.

12 Claims, 4 Drawing Figures

FIG. 3
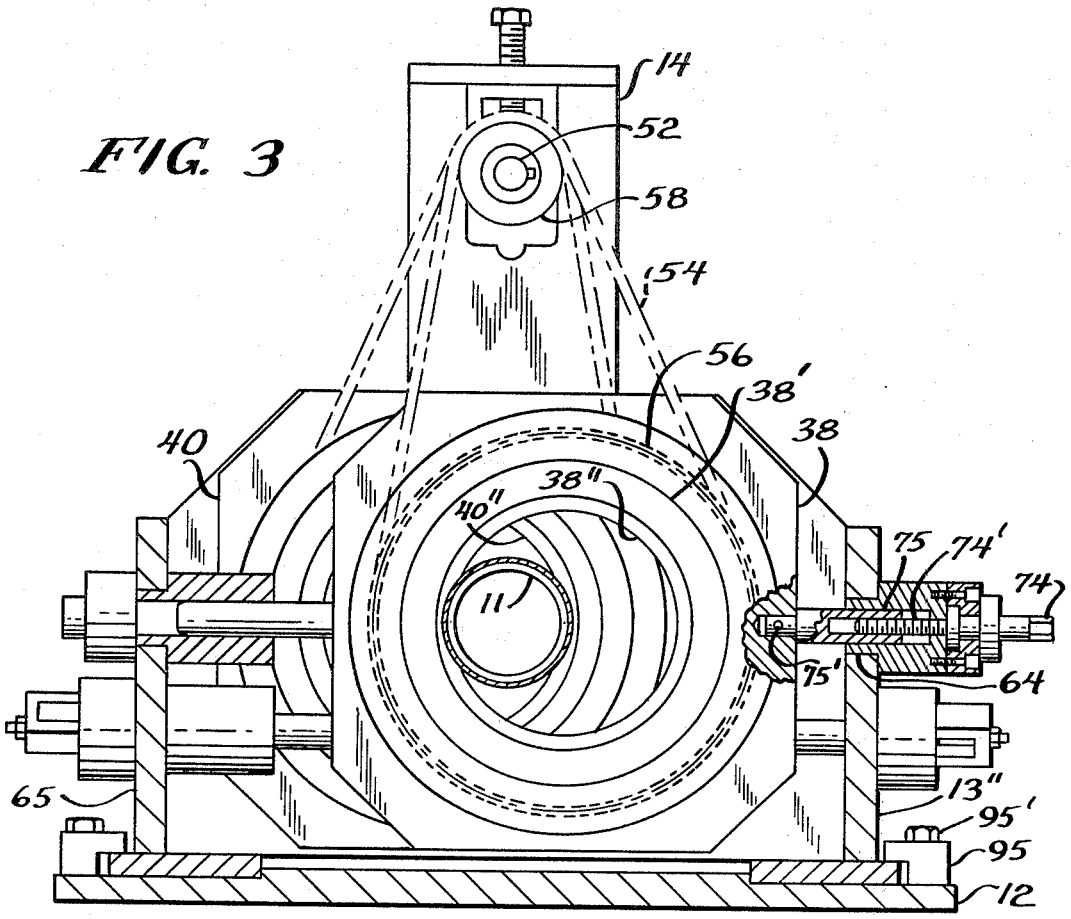
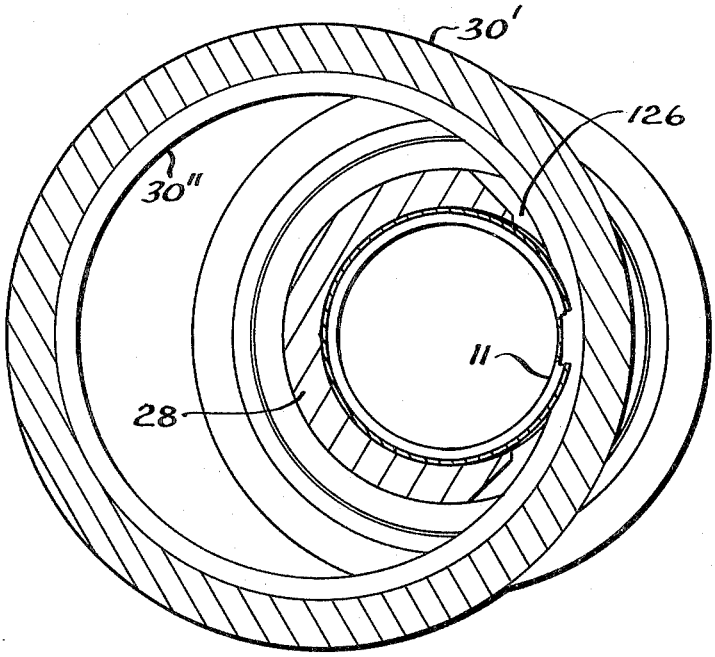
FIG. 4

ANNULAR CORRUGATOR

BACKGROUND OF THE INVENTION

The invention relates to the manufacture of corrugated metal hose from thin-walled, seamless or butt-welded smooth tubing, and more particularly, to the formation of annular corrugations in such tubing on a continuous basis. The invention is an improvement on the invention disclosed in co-pending application Ser. No. 202,909 filed in the name of John R. Pressman on Nov. 3, 1980, now U.S. Pat. No. 4,339,936 granted July 20, 1982, and assigned to a common assignee. The disclosure of said Pressman application, now U.S. Pat. No. 4,339,936 is herein incorporated by reference.

It has been known in the art, as disclosed in U.S. Pat. Nos. 3,128,821 and 3,353,389, that helical metal hose can be manufactured on a continuous basis by either rotating a tube through annular die rings which themselves are free to rotate, or by rotating the die rings about a non-rotating tube. Another process for making helical corrugations uses tapered helical dies rotating about a drawn tube moving in a straight line.

Annular metal hose is typically made by relatively slow procedures such as the internal bulging process and the external inward-forming process. The internal bulging process can produce excellent corrugation shapes, but operates at a relatively low speed and can only make relatively short lengths. The process utilizes a solid rubber bung which is compressed to prebulge the tube after which the corrugation is formed by axial compression. The external inward-forming method depends on either preforming the tube by mechanical pressure using multi-finger type dies, or by pregrooving using a rotary planetary motion around the tube, both prior to forming of the corrugation by axial compression of the tube.

Although helical metal hose has been able to be produced at a much faster rate, and thus at a lower cost than annular tubing, it has a tendency to twist when compressed or extended axially, leading to undesirable torsional stresses within the hose and at its fitting attachment joints. It is also considerably more difficult to assemble to end fittings since the weld must pass through the root of a corrugation. Alternatively, portions of the hose are left uncorrugated to facilitate the application of fittings. Because of the above factors, the industry has a substantial preference for annular metal hose.

Obviously, in view of its advantages, it would be advantageous if one could manufacture annular metal hose in a continuous fashion similar to the manner in which helical hose is formed. U.S. Pat. No. 2,429,491 discloses a forming tool having a plurality of split, helically mounted discs which can produce a relatively rigid, annularly finned, smooth bored tube of the type used in heat exchangers. However, the resulting tube, in which the fins are formed by displacing the metal of the tube wall, has no correspondence to a metal hose. In a metal hose, the wall thickness stays generally constant and the final hose length is much shorter than the original tube due to the fact that the wall is progressively formed inwardly and outwardly, without any significant change in wall thickness, as the corrugations are produced. U.S. Pat. No. 3,656,331 discloses an apparatus that purports to produce annular corrugated tubing with an annular die ring having an internal helical ridge of less than 360° extent and a pitch equal to the desired corrugation pitch of the finished tube. U.S. Pat. No. 4,215,559 is related to U.S. Pat. No. 3,656,331, but provides for the die ridge to have a maximum height for more than 360°. In U.S. Pat. No. 3,656,331, the depth of penetration is adjusted before the corrugation operation commences. During the operation, the tube is driven axially without rotation through a guide in a predetermined relationship to the speed of rotation of a die carrier about the axis of the tube.

The specific apparatus disclosed in the aforementioned Pressman application overcomes the problems of the prior art and permits continuous, annularly corrugated tubing to be produced. The apparatus utilizes a rolling carriage incorporating a motorized driving head to rotate the tube which in turn causes the synchronized annular die rings to rotate. This type of drive is expensive, somewhat cumbersome, and limits the length of tube that can be processed since the turning torque induced by the driving head at the trailing end of the tube must be transmitted by the leading end of the tube to rotate the dies. It has been further found that the specifically disclosed Pressman apparatus cannot produce annularly corrugated tubing of a 2" or greater diameter with deep corrugations and a very thin wall, such as 0.012" or 0.016", since the tubing tends to collapse from the pressure of the first dies to contact it.

SUMMARY OF THE INVENTION

It is among the objects of the present invention to provide an apparatus which can form metal hose having annular corrugations on a continuous basis and without leaving tool marks on the work which could weaken it or affect its appearance. Another object is to form such corrugations in tubing having a very thin wall and of a diameter up to at least 6–8". These and other objects are accomplished by the apparatus of the present invention in which a plurality of dies, each having the form of an angled helical rib formed on the inner periphery of an annular ring, are closely arranged in pairs adapted to engage opposed surfaces of the tube. Depending upon the tube diameter, there are at least two pairs of dies, and preferably three, arranged in spaced stages so that corrugations are produced gradually and so that there is sufficient contact with the tube to minimize slippage. No matter how many dies are utilized, it is preferable that each successive die have at least the principal portion of its helical rib at a closer or smaller pitch than the corresponding rib portion of the preceding die and that the ribs be dimensioned so as to progressively deepen the corrugations. It is desirable to have at least one complete convolution of a helical rib on each die and preferably several on the final dies so as to smooth out the corrugations and to increase the contact driving area between the dies and the tube. The dies are preferably arranged so that they can rotate in equal angular synchronization relative to each other by a series of timing chains which are mounted to sprockets which are slidably fixed to a common shaft. In the disclosed embodiment, the synchronized dies are rotated by virtue of the fact that the common shaft is driven by a motor. The rotating dies frictionally engage the tube and produce a rotation of the tube. They also cause the tube to advance axially. Although this type of drive requires the lead end of the tube to be driven until all of the sets of dies are in working contact with the tube, it eliminates the need to drive the trailing end of the tube. Thus, the tube can be very long, such as 200' or more, for example, and can be guided by a simple trough which is preferably lined with nylon or other low friction material to reduce drag on the rotating tube.

Although it is preferable that each successive die have a helical rib portion at a closer pitch than the corresponding portion of the preceding die, it is not essential in the situation where there are at least three die rings in operation and small diameter tubing is being produced which requires only a small amount of reduction. For example, in a machine having four dies and capable of producing ¼"-1½" diameter corrugated tubing, the dies for forming ¼" tubing might have, respectively, 4, 6, 6, 10 threads per inch while the dies for ½" tubing might have 3½, 5½, 7 and 8 t.p.i. In the first instance, the two center dies can be duplicates to save tooling cost and the second die with 6 t.p.i. would merely serve to transfer the tube, help maintain its driving relation with the other dies and maintain a radial pressure on the tube relative to the opposing pressure exerted on it by the immediately adjacent dies or guides.

The die rings, from the second die to the penultimate die, inclusively, preferably have the first revolution of their helical rib formed at a pitch which is equal to or at least quite close to the pitch of the principal portion of the helical rib of the preceding die. This is easily accomplished by adding an insert to the upstream or entrance end of each of these dies. The arrangement ensures that the corrugation formed by each die will be correctly guided into each succeeding die and will uniformly and gradually be compressed by the succeeding die, with no chance of the tube being cross-threaded. Alternatively, the dies could be formed so that the thread pitch changed uniformly within the die.

The ability of the apparatus to corrugate tubing in sizes of 2" or more from thin wall stock having a thickness of only 0.012–0.016", for example, is dependent on providing guiding for the tube while it is in the first die to firmly engage those portions of the periphery of the tube which, in the absence of the guiding, would be forced radially outwardly due to the pressure of the die on the tube. The guide, which is fixed, extends through and slightly beyond the first die and completely surrounds the tube except that it has an aperture or window in its periphery at one location so that the tube contacting area of the first die can contact the tube. The guide preferably has an internal diameter about 0.030–0.075" greater than the outer diameter of the tube and causes the tube to remain generally round, thus preventing its collapse. The fixed guide necessarily exerts a substantial contact force on the rotating, axially advancing tube, and thus must be made of a material which will provide good wear characteristics. Brass guides generally have a very limited wear life while tool steel guides sometimes have a tendency to seize the workpiece, which is generally made of stainless steel. A quite satisfactory guide material has been found to be an aluminum bronze alloy sold under the tradename Ampco No. 25.

To initiate a corrugating operation wherein the dies drive the tube, it is necessary to initially rotate the tube by an external source. This is preferably accomplished by passing the lead end of the tube through the retracted dies, placing an arbor in the end of the tube and forcing some gripping members such as screws which are mounted on an axially, slidable, rotatable head against the tube and its underlying arbor. The head is then rotated while the first die stage is brought into full engagement with the tube. As the annular corrugations formed in the rotating tube by the first stage are helically advanced by contact with the helical dies into the second stage, the latter dies are brought into full engagement with the tube. A similar procedure is followed for the third stage, after which the arbor is removed and the head is released from its driving engagement with the tube. This "tube-starting" procedure must be followed with every tube length to be inserted in the machine, causing a loss of the portion of the tube between the leading end and the first complete corrugations. This loss can be reduced from several feet to a few inches by attaching the succeeding length of the tube to be formed to the tube being processed while the latter is still engaged by the dies. The attachment can be accomplished with silver solder, for example. By use of the latter procedure, one could form an indefinite number of tubes after using the tube-starting mechanism to start the first one.

To render the apparatus as versatile as possible, the various dies are preferably mounted so that they can be tilted, moved axially relative to the tube axis, or moved transversely of the tube axis. Axial movement of the dies relative to the tube can be achieved by rotation of one die relative to the next, by movement of the die blocks relative to the base of the apparatus, or a combination of both.

BRIEF DESCRIPTION OF THE DRAWINGS

FIG. 3 is an end view taken on line 3—3 of FIG. 1; and

FIG. 4 is a sectional view taken on line 4—4 of FIG. 2.

DESCRIPTION OF THE PREFERRED EMBODIMENT

Figure 1:
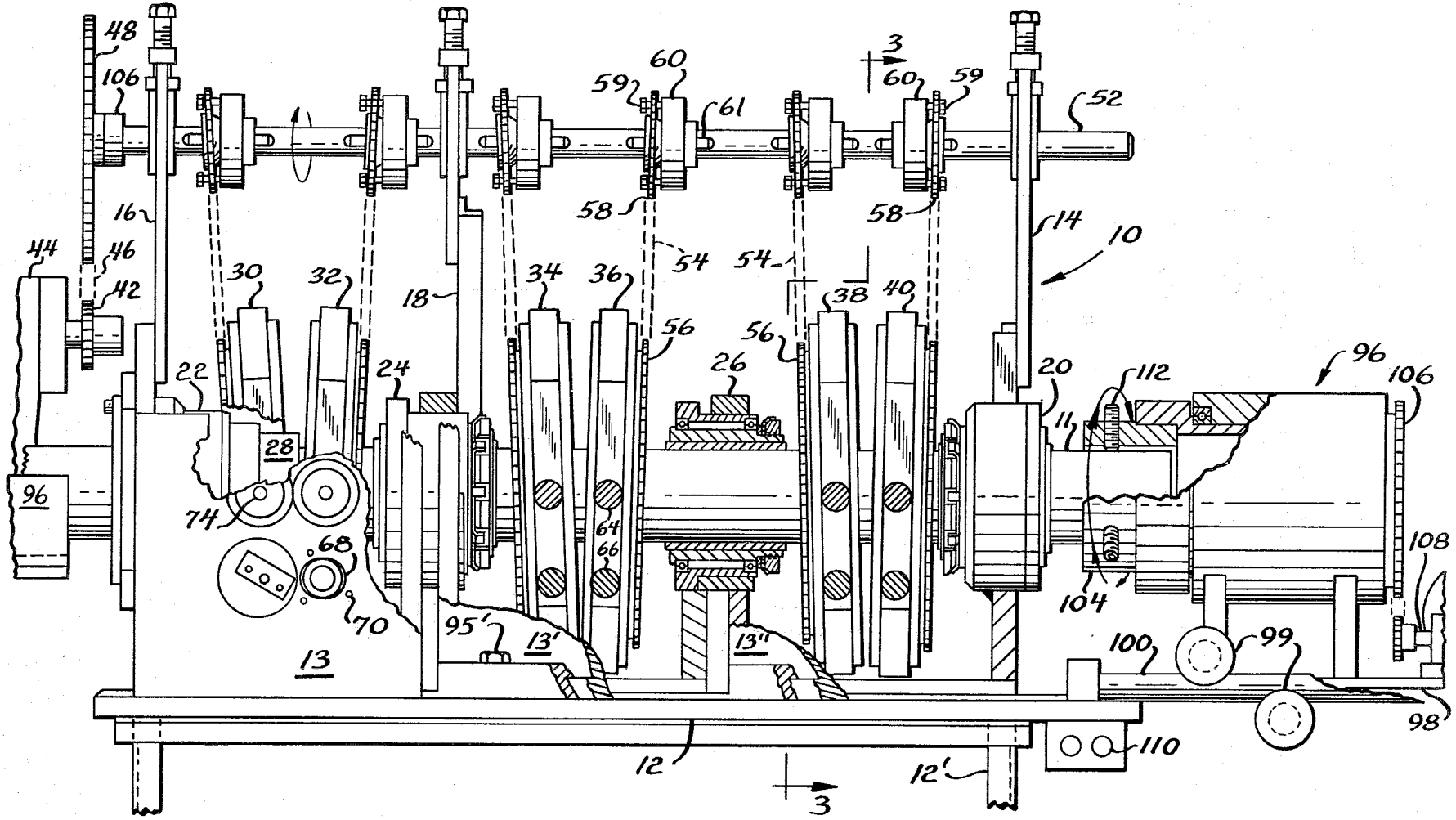
FIG. 1 is a front plan view of the corrugating apparatus of the invention with some portions partially broken away or sectioned for clarity.

Referring to FIG. 1, the improved annular corrugating apparatus is indicated generally at 10 and shows a tube 11 prior to the initiation of the corrugating operation. The apparatus has a horizontal support base 12 carried by legs 12', a fixed front vertical support plate 13, movable front support plates 13', 13", and a plurality of axially transverse support plates 14, 16 and 18. Tube support bearings 20, 22, 24 are mounted in the plates 14–18 and an additional tube support bearing 26 is also provided. A non-rotating bearing or guide 28 extends outwardly from the housing of bearing 22 and will be described in more detail in connection with FIG. 2. Positioned between the bearings are 3 die stages, the first of which comprises first die block 30 and second die block 32. The second stage comprises third die block 34 and fourth die block 36, while the third stage comprises fifth die block 38 and sixth die block 40. The number of die blocks provided can vary depending upon the diameter and range of tube sizes to be produced with the apparatus. However, we have found that three stages work quite well.

Power to drive the die blocks is provided by a motor (not shown) which drives a small sprocket wheel 42 through a speed reducing drive mechanism 44. A chain 46 then drives a large sprocket wheel 48 which is fixed for rotation with a synchronizing shaft 52 mounted at the top of the apparatus. A plurality of sprocket drive chains 54 connect large sprockets 56 carried by each die block to small sprockets 58 which are mounted by bolts 59 on mounting heads 69 keyed to shaft 52. The small sprockets 58 have a ball joint mounting (not shown) within the mounting heads 60 and the heads 60 are nonrotatably keyed to key slots 61 so they can move axially of the idler shaft 52. Thus, movements of the drive chains 54, which must take place as the die blocks 30–40 are tilted or moved axially, can be readily accommodated.

Each of the die blocks or holders 30–40 are mounted for tilting movement about a tilt shaft 64 and alternate die blocks are mounted for movement toward or away from the tube axis from either the front support wall 13 or the rear support wall 65. Shafts 66 in each die block can move in elongated slots 68 in the front or rear walls 13, 65 and are locked in varying positions of tilt adjustment by screw fasteners 70. The correct angle of tilt of any particular die will be the angle at which the helical thread ribs 30″–40″ (FIG. 2) will contact the tube 11 in a plane normal to the axis of tube 11. Since alternate dies, such as dies 38 and 40, will contact the tube on the back and front side, respectively, of the ribs 38″, 40″, the pair of dies which form each stage must be tilted in opposite directions.

The penetration depth of each die rib 30″–40″ is controlled by a feed device which could be mechanically, pneumatically, or hydraulically activated, but is shown in FIG. 3 as a manually operable member 74. The member 74 rotates but does not move axially to turn threaded portion 74′ which is engaged with an axially movable but nonrotatable nut member 75. The nut member 75 is pinned to the die block 38 by a pin 75′.

FIG. 3 is an axial end view taken on line 3—3 of FIG. 1 and illustrates the mechanism 52–58 for synchronizing the rotation of the various dies 38″, 40″. The view also illustrates a means 74, 74′ and 75 for moving the dies (die 38″ is shown) into or out of engagement with opposite sides of the tube 11.

Figure 2:
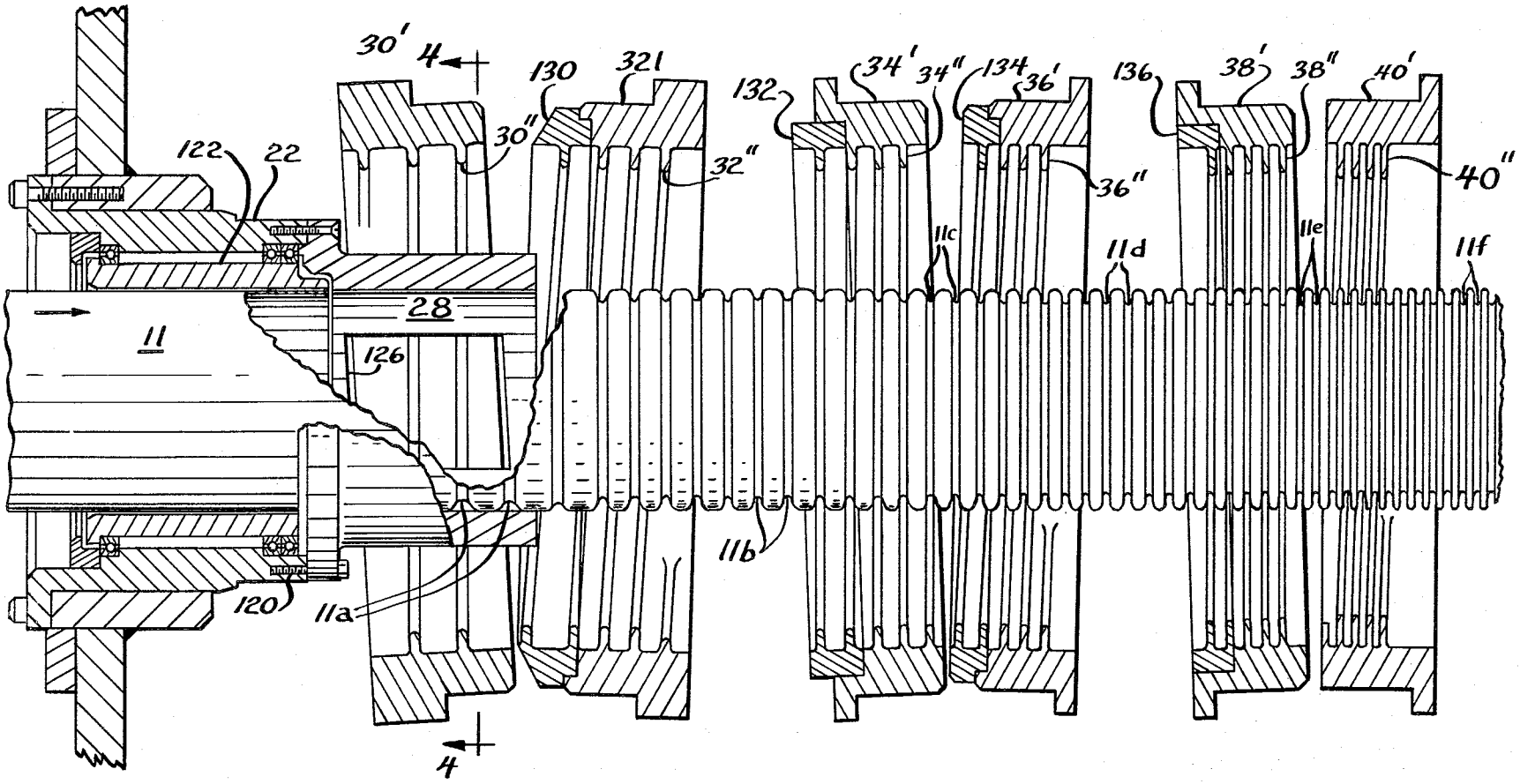
FIG. 2 is a front view showing the dies in section and also illustrating the apertured tube support guide which projects within the first die.

When the apparatus is being set up to corrugate a particular tube, it is necessary that the corrugations produced by each die to the left in FIG. 2 be picked up by a lead-in portion of the die thread in a succeeding die. Looking at FIG. 2, the corrugation 11*a* should arrive at the die 32′ so that it is exactly aligned with the lead-in segment 32‴ of the die rib or thread portion 32″. This can be accomplished by slightly rotating the downstream die relative to the upstream die as needed. Additional axial adjustment of the die blocks can be obtained by moving the vertical walls 13′, 13″, 65 relative to the base 12 and clamping them with clamp angles 95 and bolts 95′. In order to accommodate the in-and-out movement of the die blocks and tilting of the dies, some slack is left in the chains 54 or chain tighteners are provided in the form of idler sprockets (not shown) which are weight or spring biased into engagement with the chains 54.

In operation, as seen in FIG. 1, a tube 11 which is to be corrugated into a metal hose is positioned in an angle type feed trough 96 positioned at the upstream end of the apparatus. The trough is preferably lined with nylon or other low friction material. The length of the tube 11 which can be accommodated is dependent mainly on the space available to the left of the apparatus, and to a lesser extent on the weight of the tube, the power of the drive 44, and the amount of friction contact surface existing between the dies and the tube for driving the tube without slippage. Since the tubing 11 is not driven upstream of the apparatus but rather is driven by virtue of its contact with the several corrugating die ribs 30″–40″, it will be obvious that a means must be provided for initially "threading" or "starting" the apparatus. The "starting" operation requires rotation of the tubing and can be accomplished by use of a starting mechanism 96 which includes a reciprocable carriage 98 which supports guide rollers 99 which are free to roll along guide tubes 100. The mechanism 96 has a housing 102 within which a rotatable combination bearing and drive collar member 104 is mounted. The member 104 is adapted to be rotated by a downstream sprocket member 106 which is driven by a motor driven drive shaft 108 having a motor (not shown) controlled by motor start switch 110. The collar member 104 has a plurality of screws 112 which are adapted to be forced into tight engagement with the end of a plain tube 11 which preferably has had a plug (not shown) temporarily placed into its end to provide a backup for the thin wall of the tube. The lead end of the plain tube 11 is passed or "threaded" through the apparatus 10 from the feed trough 96 to the collar 104 at a time when all of the die rings 30″–40″ have been backed out of their operative positions. After the lead end of the tube is engaged by the screws in the collar 104, the starter motor is engaged to rotate the collar 104 and tube 11. The motor drive mechanism 44 is preferably disengaged by a clutch 106 from its connection with the synchronizing drive shaft 52 so that the shaft will be free to rotate when the die rings are engaged by the rotating tube. The first die ring 30 is then brought into full engagement with the tube after the tube surface is contacted by the second ring 32. This frictional engagement between the rotating tube and the die rings will initiate rotation of all the die rings 30–40 and the synchronizing shaft 52. As the first stage ring 30 engages the tube, it is frictionally rotated by the tube and produces the shallow corrugations 11*a*. This action causes the tube to be helically advanced and forces the tube starting mechanism 96 to roll to the right along the tubes 100. When the first corrugations 11*a* have been advanced to a point that they underlie the second die rib 32″, that die rib is advanced radially into full engagement with the tube to produce the slightly deeper and more closely pitched corrugation 11*b*. As corrugation 11*b* reaches die rib 34″, that rib is brought into full engagement to produce corrugation 11*c*. Similarly, die ribs 36″, 38″ and 40″ are brought into engagement as they are reached by corrugations 11*c*, 11*d* and 11*e*, respectively. Since the die ribs only contact one side of the tube, it is necessary to bring the second die of each of the three stages into touching contact with one side of the tube before the opposed side of the first die of the stage is brought into full engagement. This contact provides the necessary support for the tube which would otherwise bend.

By the time the tube has been engaged by the last die ring 40′, it is in firm frictional engagement with the die rings and can be released from the tube starting mechanism by unscrewing the locking screws 112 in the collar 104 and removing the back-up plug (not shown). The clutch 106 is then adjusted to lock the sprocket 48 to the shaft 52 and the drive mechanism 44 is started to cause the die rings to be positively driven. When the upstream end of the tube 11 is about to enter the first bearing guide 22, it is preferable that the drive 44 be stopped so that the lead end of the next tube to be corrugated can be attached to the trailing end of the tube 11. This can easily be done with silver solder, for example, after crimping the end of the new tube to fit inside the old one. In this manner, the corrugations on successive tubes can be formed without having to "re-thread" the machine, and with a loss of only a few inches of length in the region of the solder connection. Alternatively, the tube can be corrugated until its trailing end leaves the apparatus, and a new tube can be started as hereinbefore described. The latter method results in a loss of several feet of tubing between the lead end and the first complete corrugations.

A very critical portion of the apparatus is the non-rotatable bearing or guide member 28 which, as best seen in FIG. 2, extends through the central opening of the first die ring 30' in close bearing relationship with the outer wall of the incoming tube 11. The guide member 28 is mounted by bolts 120 to the bearing housing 22 in which a rotatable bearing sleeve 122 is mounted. The guide member 28 has an aperture or window 126 formed in its back wall intermediate its ends as viewed in FIG. 2. This window 126 permits access by the die rib 30" to the tube 11 so it can produce the corrugation 11*a*. The window is preferably as small as possible so that the inside surface of the guide 28 will extend around substantially more than 180° of the circumference of the tube 11 as it is being compressed by the die rib 30". Preferably, the I.D. of the guide 28 is between about 0.030–0.075" greater than the O.D. of the tube 11. Thus, the forces exerted on the side of the tube by the die rib 30" will be transferred by the tube to the walls of the guide 28, especially the walls which are at right angles to the rib force. The rigid cylindrical restraint provided by the guide prevents collapse of the tube 11 due to corrugating forces. This is an extremely important advantage when the tube is of such a large diameter and such a small wall thickness as to be incapable of being corrugated without such support. For example, a tube having a wall thickness of 0.012" and a diameter of 2", or a tube having a wall thickness of 0.016" and a diameter of 4" can easily be corrugated with the use of the guide. Without the guide, the minimum possible wall thickness for a 2" tube appears to be about 0.020" when using a machine of the type disclosed in the Pressman application, Ser. No. 202,909, or about 0.016" when using the external inward-forming type of machine.

Another important feature of the invention is the provision for a lead-in rib portion 130–136 for each of the die rings 32'–38' respectively, which preferably has the same pitch as the principal rib portions 30"–36" of the preceding die. The lead-in portions 130–136 are preferably formed as inserts which blend smoothly into the principal rib portions. By providing them with the same pitch as the preceding die ring, any problem of a succeeding die engaging the side of an incoming corrugation is eliminated. Furthermore, the lead-in portions, which must extend for at least one revolution, cause the compression provided by the die ring to be initiated smoothly and gradually. No insert is shown on the last die ring 40' since by this stage of the corrugating operation, the corrugations are quite deep and there is very little decrease in the pitch between the die rings 38' and 40'. Although the lead-in portions 130–136 are shown as inserts which have a completely different pitch than the ribs of the die rings to which they are attached, the die rings could each be machined with a pitch which gradually varies from one end to the other. In aforementioned lead-in portions 130–136 are quite important when high corrugations are being produced, since the thread pitch in the first die is quite large in order to provide sufficient material for the deep corrugations. The most critical need for the lead-in portions is in the second and third die rings where the largest pitch changes take place from die to die. Depending upon the tube size and the pitch and depth of the corrugations being produced, it is sometimes possible to dispense with lead-in portions on several of the die rings at the downstream end of the tubing, thus saving considerable tooling expense. Furthermore, when low corrugation tubing is being produced, it is sometimes possible to eliminate the use of lead-in portions completely when the pitch change between die rings is quite small.

The apparatus is able to produce corrugations on materials such as stainless steel, bronze and carbon steel which are commonly corrugated to form metal hose. In all instances, thinner wall material can be used than has been used in prior art equipment. A single corrugation is produced for every revolution of one of the dies 30'–40' so it is important that each die have at least one complete revolution of its die rib at full depth. It is also important that the dies have tapered entrance and exit portions which can smoothly ease the die ribs into and out of the corrugations. The taper from the I.D. of the die ring to full thread depth preferably takes place over about 90° for the first die and about 45° for the remaining dies, with the exit taper taking place over about 15°–30°. The dies preferably have an internal diameter about 2–3X the internal diameter of the hose produced.

We claim as our invention:

1. An apparatus for annularly corrugating metal tubing comprising:

(a) a first annular die ring adapted to encompass the tubing, said first die ring including a helical internal ridge portion having a tapered entrance portion and an inner diameter greater than the outer diameter of the tubing and extending circumferentially at a predetermined internal diameter for at least 360° around the interior wall of said first die and adapted to indentably bear on the exterior of said tubing in a substantially radial direction;

(b) at least a second annular die ring adapted to encompass said tubing downstream of said first die ring, said second die ring including a tapered entrance portion and a helical internal ridge which extends circumferentially for at least 360° at a predetermined internal diameter and which has an internal diameter which is greater than the outer diameter of the tubing which it is adapted to engage, the helical internal ridge in said second die ring having a smaller thread pitch than said first die ring;

(c) means for incurring relative rotation between said tubing and said die rings whereby to axially displace said tubing continually through said dies while simultaneously forming annular corrugations therein;

(d) means for synchronizing the rotation of said die rings so that they rotate at the same angular speed; and (e) a non-rotatable guide means fixedly positioned on said apparatus so as to extend within said first annular die ring but not within said second die ring, said guide means having an inner cylindrical wall which supports said tubing within said first die ring for a continuous circumferential distance of at least 180° and which is apertured to permit the helical internal ridge portion of said die ring to pass through it to engage said tubing, said inner cylindrical wall having a sufficiently small radial clearance relative to said tubing that it will be engaged by said tubing so as to prevent the collapse of said tubing as said tubing tends to assume a non-cylindrical shape when deformed by said die ring.

2. The apparatus of claim 1 wherein said first and second die rings are positioned axially adjacent each other in a first corrugating stage where they are in engagement with opposite sides of the tubing.

3. The apparatus of claim 2 wherein a second corrugating stage is provided comprising third and fourth die rings positioned downstream of said first stage.

4. The apparatus of claim 3 wherein a third corrugating stage is provided comprising fifth and sixth die rings positioned downstream of said second stage.

5. The apparatus of claim 1 wherein the die rings are positively rotated during use and the tubing is rotated solely by frictional engagement with the die rings.

6. The apparatus of claim 1 wherein the means for synchronizing comprises large sprockets carried by each die ring and small sprockets carried by a common shaft, said small sprockets being keyed to said common shaft for rotation with each other, the large and small sprocket for each die ring being connected by a sprocket chain.

7. The apparatus of claim 6 wherein said small sprockets can be moved axially of said common shaft to accommodate changes in the axial position or angle of tilt of said die rings.

8. The apparatus of claim 1 wherein the internal diameter of said die rings is approximately 2–3X the internal diameter of the corrugated tubing produced thereby.

9. The apparatus of claim 1 wherein said second annular die ring has a helical ridge lead-in portion which smoothly joins said helical internal ridge and also extends circumferentially for at least 360°, said lead-in portion having a pitch which is greater than that of said helical internal ridge of the second die ring but no greater than that of the helical internal ridge portion of the first die ring.

10. The apparatus of claim 4 wherein at least said second and third die rings have a helical ridge lead-in portion smoothly joined to a helical internal ridge, each of said lead-in portions having a pitch which is greater than the pitch of the helical internal ridge to which it is joined, but no greater than the pitch of the helical internal ridge of the preceding die ring.

11. The apparatus of claim 1 wherein the inner cylindrical wall of said guide means has an inner diameter which is about 0.030–0.075" larger than the outer diameter of the tubing which is passed through it.

12. The apparatus of claim 4 wherein tube starting means are positioned downstream of said die rings, said tube starting means being mounted for axial movement on a freely movable carriage and including a motor driven, rotatable drive collar which is adapted to be selectively attached to the lead end of a tube to rotate the end of a new tube to be corrugated during a "starting" operation in which each die ring is progressively engaged with the tube as the corrugation formed in the tube by the preceding die ring reaches it.

* * * * *